US005360021A

United States Patent [19]

Belvederi et al.

[11] Patent Number: 5,360,021

[45] Date of Patent: Nov. 1, 1994

[54] CIGARETTE MANUFACTURING MACHINE OF THE DOUBLE TOBACCO ROD TYPE

[75] Inventors: Bruno Belvederi, S.Martino di Monte S.Pietro; Duilio Balestrazzi, Anzola Emilia; Luigi Lanzarini, Crespellano, all of Italy

[73] Assignee: G.D. S.p.A., Bologna, Italy

[21] Appl. No.: 124,430

[22] Filed: Sep. 21, 1993

Related U.S. Application Data

[63] Continuation of Ser. No. 851,546, Mar. 13, 1992, abandoned.

[30] Foreign Application Priority Data

Mar. 15, 1991 [IT] Italy ..... BO91 A 000079

[51] Int. Cl.[5] ..... A24C 5/18

[52] U.S. Cl. ..... 131/84.1; 131/84.2

[58] Field of Search ..... 131/84.1–84.4, 131/77

[56] References Cited

U.S. PATENT DOCUMENTS 4,336,812 6/1982 Seragnoli ..... 131/84 R
4,589,426 5/1986 Mattei ..... 131/84.3
4,917,118 4/1990 Mangiarotti ..... 131/84.2 X
4,945,927 8/1990 Belvederi ..... 131/84.3 X

FOREIGN PATENT DOCUMENTS 1360597 7/1974 United Kingdom .
1386778 3/1975 United Kingdom .
1604270 12/1981 United Kingdom .

*Primary Examiner*—Jennifer Bahr
*Attorney, Agent, or Firm*—Cushman, Darby & Cushman

[57] ABSTRACT

In a cigarette manufacturing machine of the double rod type, two fillets of tobacco carried by two first conveyor belts are deposited onto two second conveyor belts, positioned beneath the first and carrying two respective strips of paper. Permeable to air, the four belts operate in conjunction with suction devices, ensuring that the tobacco and the papers remain pinned firmly against the respective belts, and are looped round top and bottom supports encompassing a void which is flanked on either side by the belts and exposed thus to suction; at least one of the two supports incorporates a passage by means of which the void is maintained at a pressure substantially identical to that of the environment surrounding the belts and the supports, thereby neutralizing the partial vacuum that otherwise would be created in the void with suction generated continuously through the belts.

2 Claims, 1 Drawing Sheet

CIGARETTE MANUFACTURING MACHINE OF THE DOUBLE TOBACCO ROD TYPE

This is a continuation of application Ser. No. 07/851,546, filed on Mar. 13, 1992, which was abandoned upon the filing hereof.

BACKGROUND of the INVENTION

The invention relates to a cigarette manufacturing machine of the double rod type.

In a machine of this type, as disclosed for example in U.S. Pat. No. 4,336,812, two continuous bands or fillets of tobacco are formed by causing single particles of tobacco to collect beneath two respective supports. The supports are provided by the bottom branches of two conveyor belts disposed mutually parallel and looped around corresponding beams or supporting structures providing internal chambers connected to respective sources of suction. The conveyor belts are made of a material which is permeable to air, and the bottom of each chamber communicates with holes emerging onto the back of the respective belt, such that suction can be generated through the bottom branch of each belt and the corresponding fillet of tobacco thus supported from above as it forms. The fillets of tobacco are subjected to a skimming operation during their progress along the bottom branches of the belts, for ensuring a substantially constant thickness.

The tobacco is released from the ends of the belts at a respective transfer station, or position, and taken up by a further section of the machine in which formation of the two continuous cigarette rods is brought about.

This further section of the machine comprises a bed, of which the surface uppermost provides two channels disposed substantially parallel and in vertical alignment, at least initially, with the conveyor belts carrying the fillets of tobacco. The surface in question provides support to a pair of second conveyor belts fashioned from a deformable material likewise permeable to air, for example a fabric, which are capable of movement longitudinally along the two channels.

The bed also includes an inner chamber connected to a source of suction, and with holes departing from the chamber and terminating in the channels. Thus, a force of suction can be generated through the second belts sufficient both to anchor two strips of cigarette paper directed continuously into the channels, and, to attract and hold the tobacco released from the first conveyor belts. The use of suction, initially to support the fillet of tobacco, and thereafter to cradle the cigarette paper and the tobacco together, has been proven successfully useful as a feed system.

On the other hand, it has been discovered that this same suction generates a certain degree of negative pressure in the void existing between the first and second pairs of conveyor belts, or rather between the two structures providing support to the belts, which tends somewhat to destabilize the passage of the fillets of tobacco from the first belts to the second, and thus clearly to detract from a correct formation of the continuous cigarette rods.

SUMMARY OF THE INVENTION

The object of the present invention is to provide a cigarette manufacturing machine unaffected by the drawback described above.

The stated object is realized, according to the invention, in a cigarette manufacturing machine of the double rod type, comprising two substantially parallel first conveyor belts by means of which two continuous fillets of tobacco are transferred to two substantially parallel second conveyor belts, positioned beneath the first and serving to support and advance two respective strips of paper. The first and second conveyor belts are disposed in vertical alignment at least at one end, subject to the action of respective suction means by which the continuous fillets of tobacco are caused to remain permanently in contact with the first belts and the strips of paper permanently in contact with the second belts, and supported by respective single structures encompassing a void located centrally between the belts and exposed thus to the action of the suction means.

The machine disclosed further comprises pressure balancing means designed to generate a pressure within the void substantially identical to that of the surrounding environment, thereby neutralizing negative pressure generated in the void through the action of the suction means.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
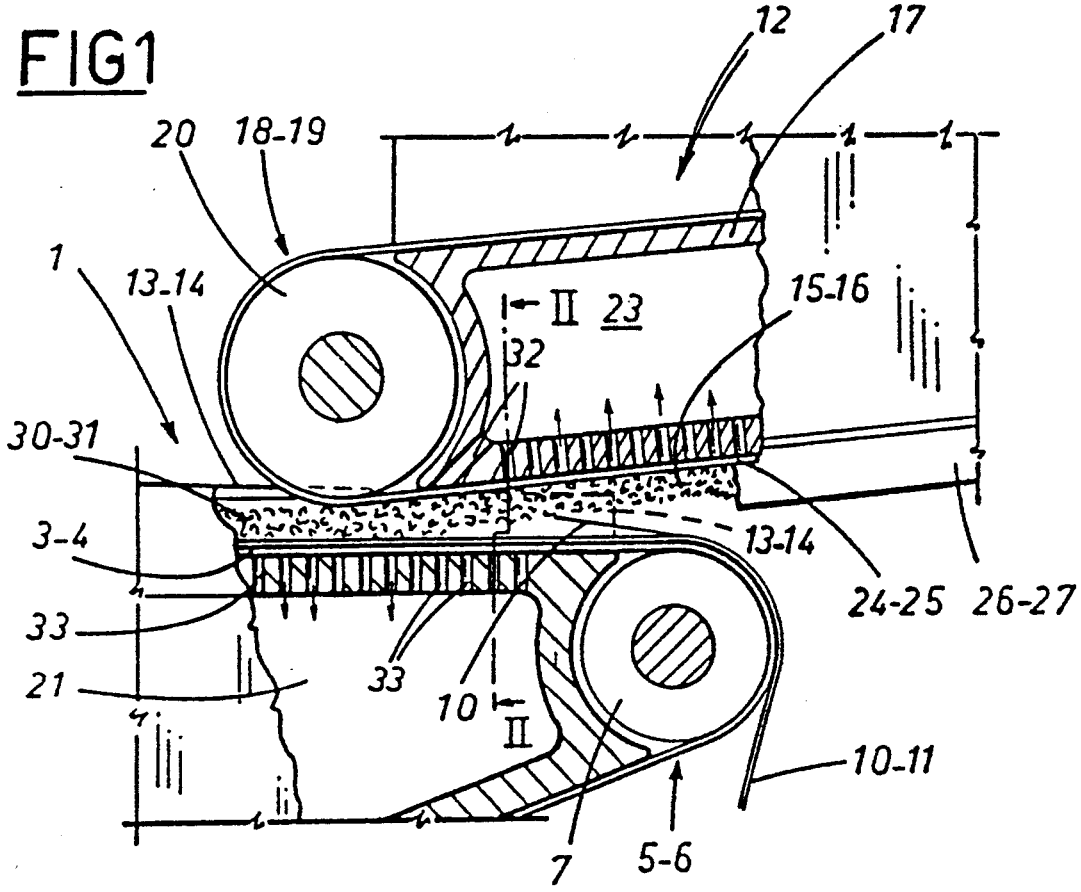
FIG. 1 is the side elevation of one detail of a cigarette manufacturing machine embodied according to the present invention, viewed with certain parts omitted better to reveal others.

FIG. 1 illustrates the outfeed end of a device 12 conveying two continuous bands or fillets 15 and 16 of particulate tobacco, also the infeed end of a bed 1 on which two continuous cigarette rods 30 and 31 are formed, in a cigarette manufacturing machine of the two-rod type.

The bed 1 is disposed substantially horizontal, and affords sliding support to the top branches 3 and 4 (see also FIG. 2) of a pair of conveyor belts 5 and 6 fashioned in a material permeable to air, such as a fabric.

Each belt 5 and 6 is joined in a closed loop and tensioned, passing around a pulley 7 at the infeed end of the bed 1.

Figure 2:
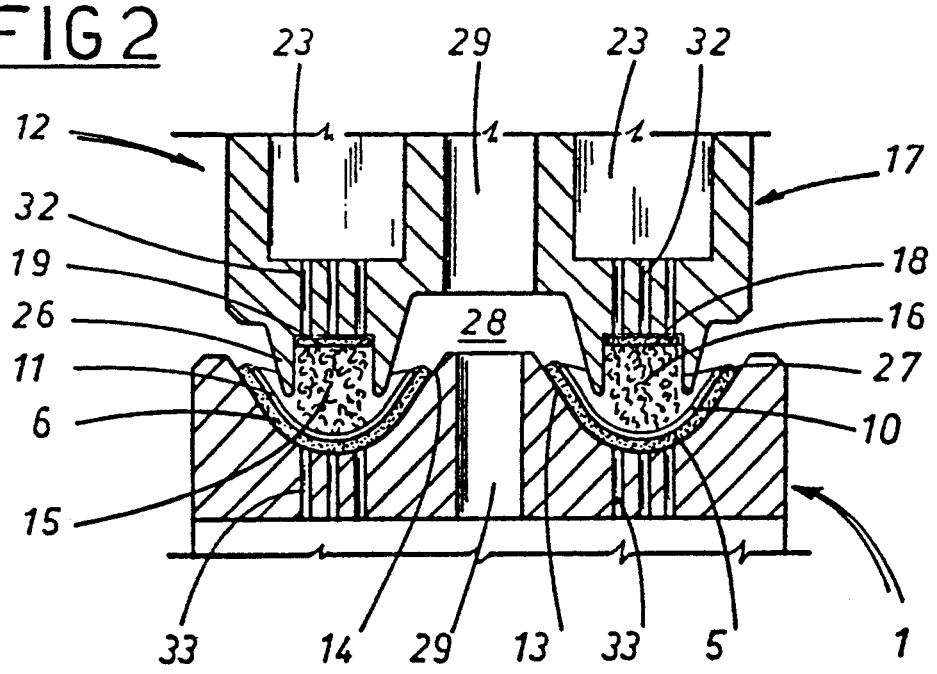
FIG. 2 is an enlarged section through II—II, FIG. 1.

The top branches 3 and 4 of the two belts 5 and 6 serve to convey respective strips of paper 10 and 11 along respective channels 13 and 14 provided by the upward-facing surface of the bed 1 (see FIG. 2). The outfeed end of the feed device 12, conveying the continuous fillets of particulate tobacco 15 and 6, is positioned over the infeed end of the bed 1 (see FIG. 1).

The feed device 12 comprises a beam 17 slidably supporting a pair of looped conveyor belts 18 and 19 passed around a pulley 20, at the outfeed end of the device; these belts also are fashioned in a material permeable to air, e.g. a fabric. As discernible from FIG. 1, the supporting structure associated with each pair of belts, i.e. the bed 1 and the beam 17, provides a respective internal chamber 21 and 23 connected with respective means of generating suction (not illustrated).

The chamber 21 of the lower structure 1 connects uppermost with a plurality of passages 33 emerging onto the surfaces occupied by the top branches 3 and 4 of the relative belts 5 and 6, such that a degree of suction can be generated sufficient to anchor the strips of paper 10 and 11 to the belts. The chamber denoted 23 connects likewise with a plurality of passages 32 emerging onto the surfaces occupied by the bottom branches 24 and 25 of the relative belts 18 and 19, such that a degree of suction can be generated sufficient to convey the two fillets of tobacco 15 and 16 from above. Numerals 26 and 27 denote downwardly projecting fins located on each flank of and encompassing the two fillets of tobacco 15 and 16 held by the bottom branches of the conveyor belts 18 and 19.

As mentioned previously in more general terms, the channels 13 and 14 and the fins 26 and 27 of the relative supporting structures 1 and 17 combine to encompass a void 28 which, as discernible readily from FIG. 2, is exposed to both pairs of belts 18–19 and 5–6, hence also to suction generated through the respective passages 32 and 33; the resulting negative pressure creates a partial vacuum in the void 28, which if unchecked can give rise to the destabilization mentioned at the outset, and more exactly, the attraction of tobacco particles from the fillets 15 and 16 into the void 28.

According to the invention, such destabilization is prevented by the exposing the void 28 to the action of pressure balancing means 29, which are designed to raise the pressure in the enclosed space to a level substantially identical to that externally of the first and second belts 18–19 and 5–6, thereby neutralizing the negative pressure created in the void by suction.

As illustrated in FIG. 2, such pressure balancing means consist in at least one passage 29 provided by at least one of the supporting structures 1 or 17, through which the void 28 is vented directly to the environment occupied by the machine.

In a preferred embodiment of the invention, the void 28 is connected to the surrounding environment by way of passages 29 provided both by the bed 1 and by the beam 17.

The passages 29 can might simply be vented to the ambient air surrounding the machine, or connected to a source of pressurized air which, being conventional, is not illustrated.

Thus, pressure within the void 28 is raised above that registering through the passages 32 and 33, and prevents the force of suction generated through the belts from producing any effect internally of the void 28.

What is claimed:

1. A cigarette manufacturing machine of the double rod type, comprising:

two substantially parallel first conveyor belts for respectively carrying two continuous fillets of tobacco toward a transfer station;

two substantially parallel second conveyor belts for supporting and advancing two respective strips of paper, said second conveyor belts being positioned beneath and in vertical alignment with respective ones of said first belts, at least in the vicinity of said transfer station, in such a way as to take up respective ones of said fillets of tobacco from beneath;

suction means respectively associated with and operated in conjunction with said first belts and said second belts for causing said continuous fillets of tobacco to remain in contact with respective ones of said first belts and for causing said strips of paper to remain in contact with respective ones of said second belts due to suction action of said suction means;

a top support structure and a bottom support structure, around which said first and the second conveyor belts are looped, said top and bottom support structures cooperatively encompassing means defining a void which is located centrally between said first and second conveyor belts and exposed to said suction action of said suction means; and pressure balancing means for generating a pressure within said void, which pressure is substantially identical to that of the environment surrounding said cigarette manufacturing machine, thereby neutralizing negative pressure generated in said void through said suction action of said suction means, said pressure balancing means comprising at least one passage through both said top and bottom support structures.

2. The cigarette manufacturing machine of claim 1, wherein:

said at least one passage vents said void to said surrounding environment.

* * * * *